US012256873B2

(12) United States Patent
Ford et al.

(10) Patent No.: US 12,256,873 B2
(45) Date of Patent: Mar. 25, 2025

(54) SUPPORT DEVICE FOR SHOWERING OR TOILETING

(71) Applicant: FOR-DE GROUP PTY LTD, Malaga (AU)

(72) Inventors: Kerry John Ford, Malaga (AU); John Van Kappel, Malaga (AU)

(73) Assignee: FOR-DE GROUP PTY LTD (AU)

( * ) Notice: Subject to any disclaimer, the term of this patent is extended or adjusted under 35 U.S.C. 154(b) by 207 days.

(21) Appl. No.: 17/634,678

(22) PCT Filed: Aug. 14, 2020

(86) PCT No.: PCT/AU2020/050855

§ 371 (c)(1),
(2) Date: Feb. 11, 2022

(87) PCT Pub. No.: WO2021/026618

PCT Pub. Date: Feb. 18, 2021

(65) Prior Publication Data

US 2022/0322889 A1 Oct. 13, 2022

(30) Foreign Application Priority Data

Aug. 15, 2019 (AU) ..... 2019902958

(51) Int. Cl.
*A47K 3/28* (2006.01)
*A47C 4/02* (2006.01)
(Continued)

(52) U.S. Cl.
CPC ..... *A47K 3/282* (2013.01); *A47C 4/02* (2013.01); *A47C 5/10* (2013.01); *A47C 7/546* (2013.01); *A47K 13/105* (2013.01); *A47C 4/03* (2013.01)

(58) Field of Classification Search
CPC ..... A47K 3/282; A47K 13/105; A47C 7/546; A47C 4/03; A47C 4/02; A47C 5/10
(Continued)

(56) References Cited

U.S. PATENT DOCUMENTS 5,373,591 A 12/1994 Myers
6,164,722 A * 12/2000 Mabey ..... A47K 3/282 4/578.1

(Continued)

FOREIGN PATENT DOCUMENTS

CN 201759452 U 3/2011
GB 2542571 A 3/2017
WO 0182761 A1 11/2001

OTHER PUBLICATIONS

International Search Report in corresponding PCT/AU2020/050855 dated Aug. 31, 2020.

(Continued)

*Primary Examiner* — David R Dunn
*Assistant Examiner* — Tania Abraham
(74) *Attorney, Agent, or Firm* — Blanchard Horton PLLC

(57) ABSTRACT

The present invention relates to a support device for assisting a user in showering or toileting. The support device comprises a seat comprising a seating surface for supporting a weight of the user; a plurality of legs attached to the seat; a pair of handles configured to attach to substantially opposite side portions of the seat, each handle comprising a pair of end portions for attaching to the seat; and a securing element for securing each handle to the seat; wherein each of the substantially opposite side portions of the seat comprises a plurality of receptacles for snugly fitting the end portions of a respective handle, and wherein the support device is configured such that a portion of the user's weight on the handles of the support device applies a force that has (Continued)

a force component directed into each receptacle and parallel to a central axis of each receptacle.

17 Claims, 6 Drawing Sheets

(51) Int. Cl.
*A47C 5/10* (2006.01)
*A47C 7/54* (2006.01)
*A47K 13/10* (2006.01)
*A47C 4/03* (2006.01)

(58) Field of Classification Search
USPC ..... 297/440.24
See application file for complete search history.

(56) References Cited

U.S. PATENT DOCUMENTS 6,974,191 B2 * 12/2005 Serhan ..... A47K 3/282 4/578.1
7,121,620 B1 * 10/2006 Fang ..... A47K 3/122 297/51
7,690,055 B2 * 4/2010 Hammer ..... A61G 7/1003 4/560.1
10,575,687 B1 * 3/2020 Ehrenberg ..... A61G 5/022
10,722,033 B1 * 7/2020 Chen ..... A47C 3/18
2003/0102700 A1 * 6/2003 Lin ..... A47K 3/122 297/344.18
2008/0136244 A1 6/2008 Cheng
2011/0239364 A1 10/2011 Goldstein
2012/0233767 A1 * 9/2012 Liu ..... A47K 3/125 4/578.1
2016/0278529 A1 * 9/2016 Paterson ..... A47C 4/03
2019/0029474 A1 * 1/2019 Preece ..... A47K 3/282

OTHER PUBLICATIONS

Written Opinion of the International Searching Authority in corresponding PCT/AU2020/050855 dated Aug. 31, 2020.
Australian Examination Report in corresponding Application No. 2020327867 dated Oct. 26, 2021.
Supplementary European Search Report mailed Jun. 28, 2023 in corresponding European Patent Application No. EP20851834.

* cited by examiner

SUPPORT DEVICE FOR SHOWERING OR TOILETING

CROSS-REFERENCE TO RELATED APPLICATIONS

This application is a National Stage of International Application No. PCT/AU2020/050855, filed on Aug. 14, 2020, which claims priority to Australian Patent Application No. 2019902958, which is hereby incorporated by reference in its entirety.

TECHNICAL FIELD

The present invention relates to a support device for assisting a user in performing daily activities, such as showering or toileting. The present invention relates in particular, but not exclusively, to a or showering chair or stool and a toilet seat riser.

BACKGROUND

The present invention is concerned generally with providing furniture and related support aids for facilitating self-care activities of elderly persons and partially disabled persons, such as chronic invalids and medical patients during rehabilitation.

Elderly persons and persons with disabilities often have difficulties performing activities of daily living, such as toileting, or, showering. Using support devices, such as a toilet seat riser, a shower chair or a shower stool, assists the persons in performing these daily activities in a relatively safe manner. For example, a shower chair or stool may reduce the risk of falling due to a slippery surface. However, conventional shower chairs and stools are commonly bulky and relatively expensive and may therefore be less accessible to the persons in need.

A toilet seat riser typically fits over a toilet bowl and assists the person using it to stand up or sit down. Again, conventional toilet seat risers are commonly quite expensive, partly due to the difficulty in properly and safely fitting the wide variety of sizes and shapes of conventional toilet bowls. Even more so, most toilet seat risers will need to be fitted into relatively tight spaces.

It would therefore be advantageous if at least an embodiment of the present invention addresses one or more problems associated with conventional support devices or at least provide a workable alternative.

Any discussion of documents, acts, materials, devices, articles or the like which have been included in the present specification is not to be taken as an admission that any or all of these matters form part of the prior art base or were common general knowledge in the field relevant to the present invention as it existed before the priority date of each claim of this application.

Throughout the specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY

Embodiments of the present invention relate to a support device for assisting a user in performing daily activities, such as showering or toileting, the support device comprising:

a seat comprising a seating surface for supporting a weight of the user;

a plurality of legs attached to the seat;

a pair of handles configured to attach to substantially opposite side portions of the seat, each handle comprising a pair of end portions for attaching to the seat; and a securing element for securing each handle to the seat;

wherein each of the substantially opposite sides of the seat comprises a plurality of receptacles for snugly fitting the end portions of a respective handle, and wherein the support device is configured such that a portion of the user's weight on the handles of the support device applies a force that has a force component directed into each receptacle and parallel to a central axis of each receptacle.

Embodiments of the present invention provide significant advantages. In particular, by attaching the handles to the seat of the support device as defined above, the handles are pushed into the receptacles when the user applies a load to the handles. In this way, the risk of the handles becoming loose or detached can be significantly reduced. Furthermore, the need for providing a complex securing element to secure the handles to the seat may be reduced or even removed. Even more so, by providing removable handles, the plurality of handles can easily be replaced and different handles may be attached to provide more flexibility.

In an embodiment, the support device is configured such that a majority force component of the force applied by the portion of the user's weight has a direction into each receptacle and parallel to the central axis of each receptacles.

In an embodiment, each handle comprises a pair of tapering end portions, and the seat comprises respective receptacles for snugly fitting the end portions of the handles. However, a person skilled in the art will appreciate that the end portions of each handle may have any suitable shape, including but not limited to round, square, having a substantially constant diameter and the like.

In an embodiment, the plurality of legs may be removably attached to the seat.

In an embodiment, the seat, the plurality of legs, the handles and the securing element are configured such that a volume of the support device can be minimised for transporting the support device. Specifically, a transport volume of the support device may be defined by a size of the seat only. For example, the transport volume may be substantially similar to a volume of the seat. This has the particular advantage that freight costs for transporting the support device can be reduced. Even more so, due to the simplified transportability of the support seat, the support seat may be used for travelling.

A further advantage of an embodiment of the present invention is that no or less tools may be needed to assemble the support device compared with conventional support devices.

In an embodiment, an angle of the central axis of each receptacle relative to a plane defined by the seating surface of the seat may range from approximately 3° to approximately 120°. In particular, the angle may range from approximately 5° to approximately 90°, or from 5° to 45°, or from 5° to 30°, or from approximately 30° to approximately 60°. In some embodiments, the angle may be approximately 3°, 4°, 5°, 10°, 15°, 20°, 25° or 30°. A person skilled in the art will appreciate that the defined force component may depend on at least the angle and a shape and configuration of the handles.

In an embodiment, the securing element is configured to restrain movement of each tapering end portion of each handle away from the respective receptacle. Such movement may for example be caused if the user lifts the support device to move it.

In a specific embodiment, the securing element may comprise a fastener configured to fasten each tapering end portion of each handle to the seat. In particular, the fastener may be in the form of a bolt, rivet or a screw, such as a thumb screw. In this regard, each end portion of each handle may comprise an internal thread. Using a thumb screw or any other hand-tighten fastener as securing element has the particular advantage that no tools may be needed to secure each handle to the seat, and that the handles may be easily removed. However, a person skilled in the art will appreciate that any suitable fasteners are envisaged.

In an embodiment, each handle may have an overall shape that is substantially C-shaped. In this particular example, larger angles between the central axis of each receptacle and the seating surface, such as above approximately 45°, may be advantageous.

In a particular embodiment, each handle may comprise a body portion that is substantially C-shaped and a pair of arms extending from the C-shaped body portion. The pair of arms may extend from the body portion at a substantially perpendicular angle. However, other suitable angles are envisaged. A person skilled in the art will appreciate that a shape or configuration of the handles may determine a suitable angle between the central axis of each receptacle and the seating surface.

In an embodiment, a handle may be shaped such that a first position of an armrest surface relative to the seat surface is provided when the handle is attached to the first side portion of the seat, and a second position of an armrest surface relative to the seat surface is provided when the handle is attached to the second, opposite side portion of the seat. In this regard, the armrest surface may be positioned at a front portion of the seat or at a rear portion of the seat where a backrest may be attached. This embodiment provides significant advantages in the functionality of the support device. In particular, by changing the relative position of the armrest surfaces to the rear portion of the seat, a larger space may be provided for the user to move the legs apart thereby providing an increased leg gating. This is a significant improvement to conventional shower chairs as it allows a user to clean body parts that would typically be difficult to reach.

Components of the support device, such as the seat and/or the handles, may be made from a plastics material, such as polypropylene (PP), polyethylene (PE), polystyrene (PS) and polyvinyl chloride (PVC). Alternatively, components of the support device may comprise nylon. However, a person skilled in the art will appreciate that any other suitable material is envisaged. Using plastics material has the particular advantage that the support device can be made relatively lightweight, water-resistant and easy to clean.

The support device may be configured such that a majority of a surface area of the seat and/or the handles is substantially smooth. In this way, cleaning of the support device may be simplified and a potential build-up of mould may be reduced or even avoided.

In an embodiment, the support device may further comprise a back rest attached to the seat. Particularly, the support device may be configured such that the back rest is removably attached to the seat. This is particularly advantageous for minimising a transport volume of the support device.

The back rest may have a shape that tapers towards an attachment of the back rest and the seat. In this way, the back rest may be less restrictive for showering purposes.

In a specific embodiment, the support device is a shower chair or stool. In this embodiment, the seat may comprise a plurality of apertures for drainage of water.

In a further embodiment, the support device is a toilet seat riser. In this particular example, the support device may be configured such that a height and/or an angle of the seat is adjustable.

Embodiments of the present invention relate to a shower chair or stool comprising:

- a seat comprising a seating surface for supporting a weight of the user;
- a plurality of legs removably attached to the seat;
- a pair of handles configured to attach to substantially opposite side portions of the seat, each handle comprising a pair of end portions for attaching to the seat; and
- a hand-tighten fastener for securing each handle to the seat;
- wherein each of the substantially opposite sides of the seat comprises a pair of receptacles for snugly fitting the end portions of a respective handle, and
- wherein the shower chair or stool is configured such that a portion of the user's weight on the handles of the support device applies a force that has a force component directed into each receptacle and parallel to a central axis of each receptacle.

Each handle of the shower chair or stool may comprise a pair of tapering end portions for attaching to the seat.

Embodiments of the present invention relate to a toilet seat riser comprising:

- a seat comprising a seating surface for supporting a weight of the user, the seat comprising a central aperture for waste disposal;
- a plurality of legs removable attached to the seat;
- a pair of handles configured to attach to substantially opposite side portions of the seat, each handle comprising a pair of end portions for attaching to the seat; and
- a hand-tighten fastener for securing each handle to the seat;
- wherein each of the substantially opposite sides of the seat comprises a pair of receptacles for snugly fitting the end portions of a respective handle, and
- wherein the toilet seat riser is configured such that a portion of the user's weight on the handles of the support device applies a force that has a force component directed into each receptacle and parallel to a central axis of each receptacle.

In an embodiment, the toilet seat riser is configured to be height adjustable. Additionally or alternatively, the toilet seat riser may be configured such that an angle of the seating surface is adjustable.

Each handle of the toilet seat riser may comprise a pair of tapering end portions for attaching to the seat.

Further embodiments of the present invention relate to a support device for assisting a user in performing daily activities, such as showering or toileting, the support device comprising:

- a seat comprising a seating surface for supporting a weight of the user;
- a plurality of legs attached to the seat; and a pair of handles configured to attach to substantially opposite side portions of the seat, each handle comprising a pair of tapering end portions for attaching to the seat;

wherein each of the substantially opposite sides of the seat comprises a plurality of receptacles for snugly fitting the tapering end portions of a respective handle, and wherein the support device is configured such that a portion of the user's weight on the handles of the support device applies a force that has a force component directed into each receptacle and parallel to a central axis of each receptacle.

It will be appreciated by persons skilled in the art that numerous variations and/or modifications may be made to the invention as shown in the specific embodiments and/or aspects without departing from the spirit or scope of the invention as broadly described. For example, it will be apparent that certain features of the invention can be combined to form further embodiments. The present embodiments and aspects are, therefore, to be considered in all respects as illustrative and not restrictive. Several embodiments are described above with reference to the drawings. These drawings illustrate certain details of specific embodiments that implement the systems and methods and programs of the present invention. However, describing the invention with drawings should not be construed as imposing on the invention any limitations associated with features shown in the drawings.

BRIEF DESCRIPTION OF DRAWINGS

Certain exemplary embodiments of the present invention will now be described, by example only, with reference to the accompanying drawings in which.

DESCRIPTION OF EMBODIMENTS

Embodiments of the present invention are concerned generally with providing furniture and related support devices for facilitating self-care activities of elderly persons and partially disabled persons, such as chronic invalids and medical patients during rehabilitation. These types of assistive furniture and support devices aim at promoting greater independence for elderly and partially disabled persons by enabling or at least improving the performance of daily routines, such as bathing, showering and toileting.

Thus, embodiments of the present invention generally relate to a support device for assisting a user in performing daily activities, such as showering or toileting. The support device may, for example, be in the form of a shower chair or stool or a toilet seat riser. The support device comprises a seat having a seating surface for supporting a weight of a user, and a plurality of legs attached to the seat. The support device further comprises a pair of handles configured to attach to substantially opposite side portions of the seat, wherein each handle comprises a pair of end portions for attaching to the seat. A securing element for securing each handle to the seat may also be provided. Each of the substantially opposite side portions of the seat comprises a pair of receptacles for snugly fitting the end portions of a respective handle. The support device is configured such that a portion of the user's weight on the handles of the support device applies a force that has a force component directed into each receptacle and parallel to a central axis of each receptacle.

In the following, a specific example of the support device will be described with reference to the accompanying drawings. In this specific example, the support device is implemented in the form of a shower chair or shower stool. However, a person skilled in the art will appreciate that other support devices are envisaged, such as a toilet seat riser which will also be briefly described.

Figure 1:
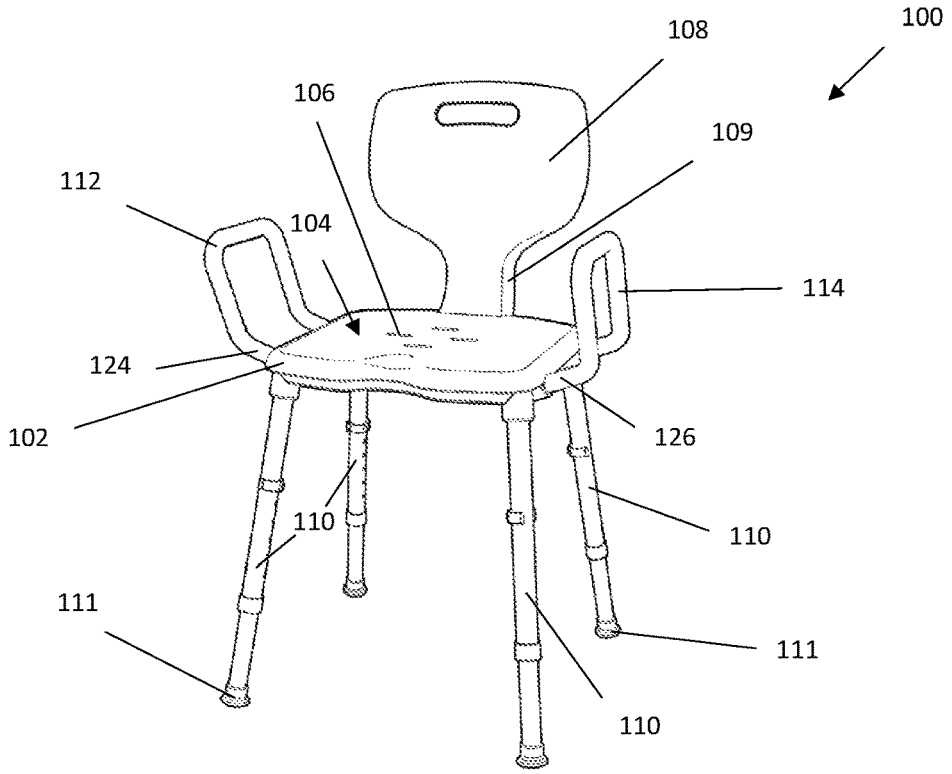
FIGS. 1 and 2 are schematic representations of a support device for assisting a user with showering in accordance with an embodiment of the present invention.
Figure 2:
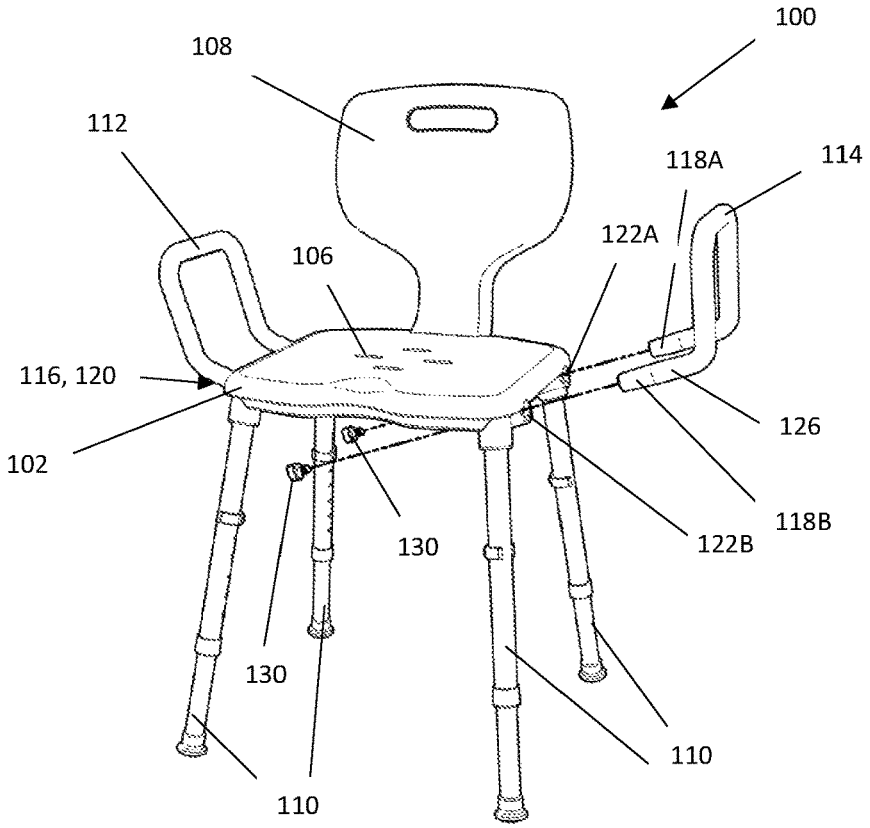

Referring initially to FIGS. 1 and 2, there is shown a support device in the form of a shower chair 100. A shower chair 100 generally enables users with mobility or balance difficulties to shower safely and independently.

The shower chair 100 comprises a seat 102 with a seating surface 104 to support a weight of the user. In this example, the seating surface 104 further comprises a plurality of apertures 106 for drainage of liquid, such as water and soap. The shower chair 100 further comprises a back rest 108 for supporting a back of the user. In this particular example, the back rest 108 is removably attached to the seat 102 to provide advantages in minimising a transport volume of the shower chair 100 as will be described in further detail below. As shown in FIGS. 1 and 2, the back rest 108 has a shape that has a tapered portion 109 towards an attachment of the back rest 108 and the seat 102. The tapered portion 109 has the function of providing access to body parts of the user that may otherwise be difficult to reach. In this way, the shower chair 100 is less restrictive for showering purposes. Even more so, the shower chair 100 may be made more lightweight compared to conventional shower chairs which may be advantageous with regard to transport costs.

The shower chair 100 further comprises four legs 110 that are removably attached to the seat 102 and a pair of handles 112, 114. The legs 110 may be height adjustable to provide more flexibility to accompany for different heights of users. In addition, each of the legs 110 may have a foot 111 that has a larger diameter than the remaining leg 110 and is made of a material that restricts the shower chair 100 from slipping on wet surfaces. For example, the foot 111 may be made from plastics material, such as PVC, rubber or the like.

Each handle 112, 114 is configured to attach to substantially opposite side portions of the seat 102. In this regard, each handle 112, 114 comprises a pair end portions 116A, 116B, 118A,118B. This is due to the shape of the handles 112, 114. In this particular example, each end portion 116A, 116B, 118A, 118B is tapered to improve attaching the handles 112, 114 to the seat 102. However, a person skilled in the art will appreciate that the end portions may have any suitable shape. For example, the end portions may have a constant diameter and/or may have a cross section that is round, or squared.

The seat 102 comprises a pair of receptacles 120, 122 on each side portion of the seat 102 for snugly fitting the end portions 116, 118 of the handles 112, 114, in this example the tapering end portions 116, 118 of the handles 112, 114. The shower chair 100 is configured such that when a user applies a portion of the user's weight on the handles 112, 114, a force is applied that has a force component directed into each receptacle 120, 122 and that is parallel to a central axis of each receptacle 120, 122. Thus, the angle of the receptacles 120, 122 and the corresponding tapering end portions 116, 118 together with a shape of the handles 112, 114 is selected so that the handles 112, 114 are pushed into the receptacles 120, 122 when the shower chair 100 is in use.

This feature provides the significant advantage that safety of the shower chair 100 is improved as the risk of the handles 112, 114 becoming loose or detached during use can be significantly reduced. Even more so, by configuring the attachment of the handles 112, 114 to the seat 102 in this way, the need for providing complex securing elements to safely secure the handles 112, 114 to the seat 102 may be reduced or even completely removed.

In this particular example, shapes of both handles 112, 114 are identical to each other. Thus, each handle 112, 114 can be attached to either side portion of the seat 102 without changing the configuration of the shower chair 100. Specifically, each handle 112, 114 comprises a main body part that is substantially C-shaped and a pair of arms 124, 126 extending from the C-shaped body part. An angle between each of the extending arms 124, 126 and the C-shaped body part in this example is larger than 90°. Specifically, the angle between the extending arms 124, 126 and the C-shaped body part is approximately 120°. This angle is selected in combination with the angle of the receptacle 120, 122 to ensure that the force component of the force applied by the portion of the user's weight on the handles 112, 114 pushes the tapering end portions 116, 118 into the receptacles 120, 122. However, a person skilled in the art will appreciate that any other suitable angle is envisaged. For example, the angle between the extending arms 124, 126 and the C-shaped body part may range from approximately 90° to approximately 180°. If the angle is approximately 180° a person skilled in the art will understand that the handle 112, 114 will assume an overall shape that is substantially C-shaped shaped.

Providing an extension in the form of arms 124, 126 projecting from the C-shaped body provides significant advantages. Specifically, a size of the seat 102 may be reduced without reducing a space for the user's body. This may have a visually appealing effect as the overall size of the shower chair 100 appears to be smaller. Furthermore, the extension in the form of arms 124, 126 may enable a user to access body parts for washing that may otherwise be difficult to reach as will be described in further detail with reference to FIGS. 6A and 6B. In this way, the shower chair 100 is less restrictive for showering purposes.

In one particular example (not shown), the shower chair 100 is configured such that a majority force component of the force applied by the portion of the user's weight has a direction into each receptacle and parallel to the central axis of each receptacles. A person skilled in the art will appreciate that the force component may depend on at least an angle of the attachment between the handle 112, 114 and the seat 102 and a shape of the handles 112, 114.

By providing most components of the shower chair 100, such as back rest 108, legs 110 and handles 112, 114 removably attachable to the seat 102, a transport volume of the shower chair 100 may be significantly reduced. Specifically, the transport volume may be substantially defined by a size of the seat 102. For example, the transport volume of the shower chair 100 may be substantially similar to a volume of the seat 102 as other components may be flat packed together with the seat 102. The inventors of the present invention have found that transport and packing costs can be significantly reduced. Even more so, due to the configuration of the shower chair 100, no tools are required to assemble this particular shower chair 100 which provides a significant advantage for self-care at home.

In one specific embodiment (not shown), one or more components of the shower chair 100 may be provided in a colour that is selected to assist a user, such as an elderly person or a vision impaired person, in identifying a position of the component. For example, the inventors of the present invention have found that elderly persons or persons with disabilities such as vision impaired persons or persons with Alzheimer, have difficulties in depth perception of white or grey objects. Thus, by providing one or more components, such as the handles 112, 114 or the seat 102, in a colour that is easily visible for the user, the usability of the shower chair 100 may be improved. The colour may be selected to provide a relatively large contrast to the colour of the remaining components of the shower chair 100. For example, the handles 112, 114 may be provided in red whilst the remaining components of the shower chair 100 may be provided in white and grey.

Figure 3A:
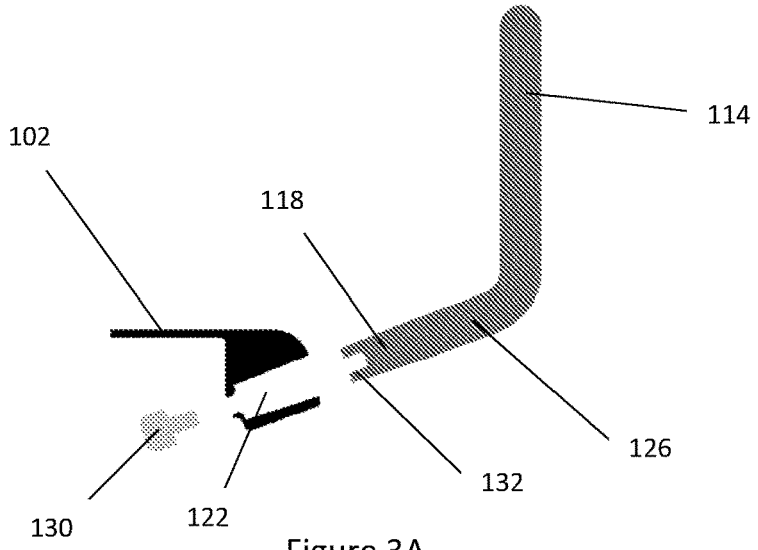
FIGS. 3A, 3B and 3C illustrate different configurations of attaching a handle to a seat of the support device of FIGS. 1 and 2.
Figure 3B:
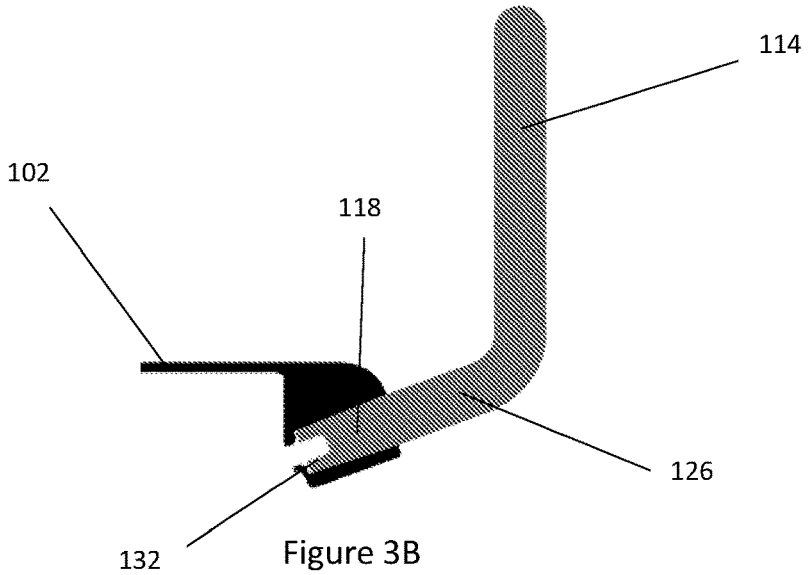
Figure 3C:
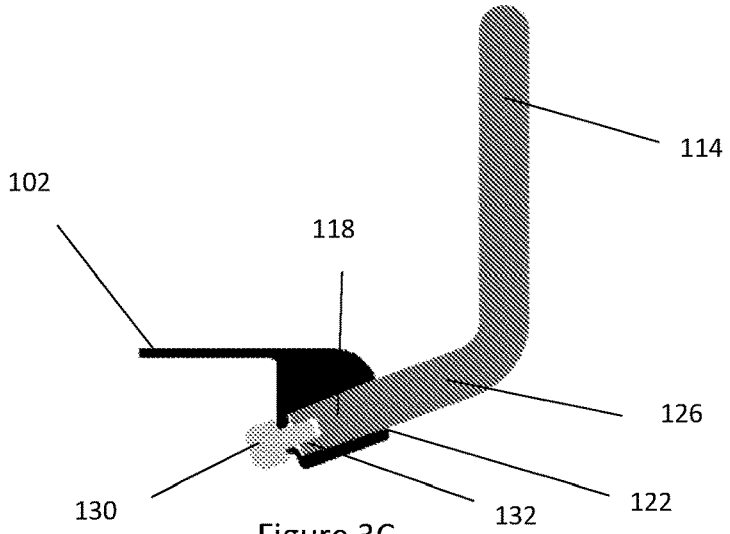

An example of the attachment of the handle 114 to the seat 102 will be described in further detail with reference to FIGS. 3A, 3B and 3C. FIGS. 3A, 3B and 3C illustrate schematic side views of the attachment in different configurations during the attachment process.

As described above, in this example the handle 114 comprises a tapering end portion 118 for snugly fitting into a receptacle 122 provided on a side portion of the seat 102. In addition, the shower chair 100 comprises a securing element 130 for securing the tapering end portion 118 of the handle 114 to the seat 102, specifically to a bottom portion of the receptacle 122. The securing element 130 is configured to restrain movement of the tapering end portion 118 of the handle 114 away from the receptacle 122. Such movement may, for example, be caused if the user lifts the shower chair 100 to move it. In this particular example, the shower chair 100 is made relatively lightweight compared with conventional shower chairs. As such, the securing element 130 is only required to withstand a relatively low force that corresponds to the weight of the shower chair 100 or less. Due to the specific configuration of the attachment between the handle 114 and the seat 102, there may be no need for the securing element 130 to withstand any force applied by the weight of the user. The inventors have found that the combination of these features allows the shower chair 100 to utilise a relatively simple securing element 130, such as a thumb screw 130 as shown in FIGS. 3A to 3C.

In an alternative embodiment, the shower chair 100 may not require a securing element 130. However, in this particular embodiment the end portions of each handle 112, 114 are tapered to ensure that the handles remain within the corresponding receptacles when the shower chair 100 is in use. The tapered end portions fit snugly in the receptacles which provides the secure attachment of the handles 112, 114 to the seat of the shower chair 100.

Furthermore, by providing handles 112, 114 that are removable, the handles 112, 114 may be replaced, for example, with handles of different heights, width or other shapes, or if the handles are damaged.

In more general terms, the securing element 130 may comprise any suitable fastener, such as a bolt, a screw, a clip, or any other type of fastener that allows the handle 114 to be secured to the receptacle 122. In preferred examples of the shower chair 100, the securing element 130 may be in the form of a hand-tighten fastener. This would allow a user to assemble the shower chair 100 without the need for any tools. The tapering end portion 118 of the handle 114 shown in this example further comprises an internal thread 132 for receiving the thumb screw 130. Once the tapering end portion 118 of the handle 114 is inserted into the receptacle 122, the thumb screw 130 can be screwed into the internal thread 132 as shown in particular in FIG. 3C. Whilst the securing element 130 in this example is a separate component of the shower chair 100, a person skilled in the art will appreciate that a part of the entire securing element 130 may form part of the handle 114 or the seat 102. This has the advantage that the securing element 130 may not be misplaced.

Figure 4:
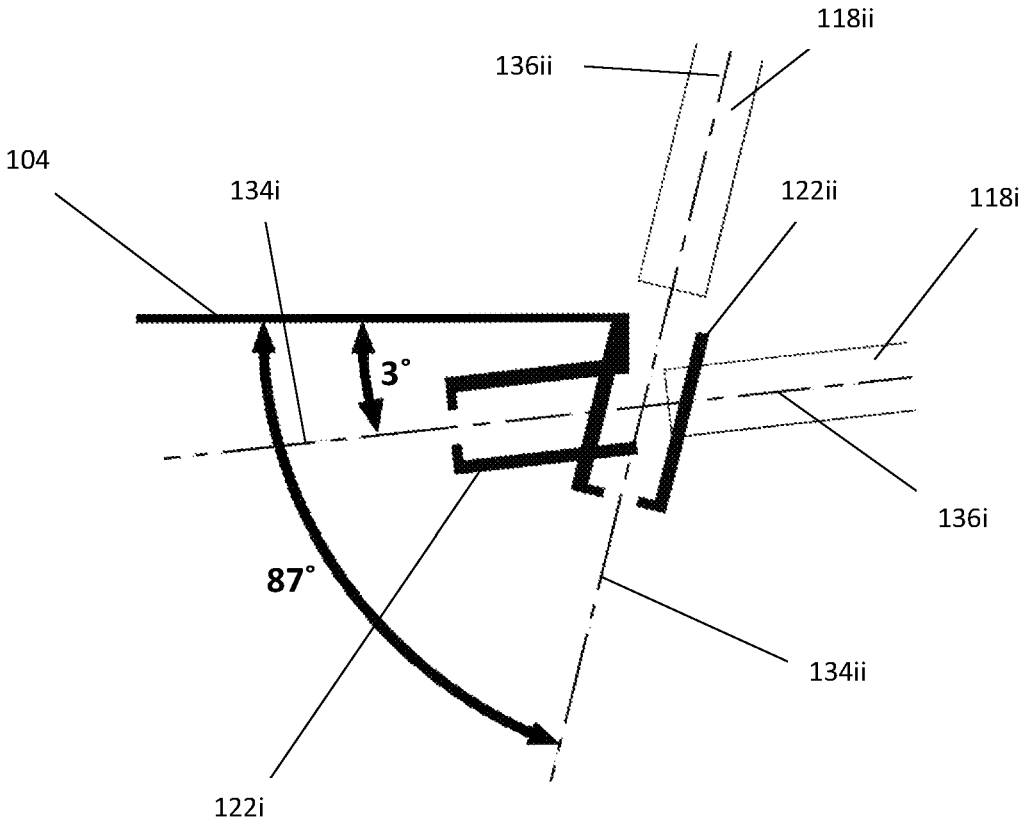
FIG. 4 illustrates a range of angles between the handle and a seating surface of the support device of FIGS. 1 and 2 before the handle is attached to the seat of the support device.

Referring now to FIG. 4, this Figure illustrates a range of angles between the tapering end portion 118*i*, 118*ii* of the handle 114*i*, 114*ii* and the receptacle 122*i*, 122*ii* in the seat 102 relative to the seating surface 104. As illustrated in the Figure, the receptacle 122*i*, 122*ii* has a central axis 134*i*, 134*ii* that extends through to a central axis 136*i*, 136*ii* of the tapering end portion 118*i*, 118*ii* when the tapering end portion 118*i*, 118*ii* is snugly fit into the receptacle 122*i*, 122*ii*. An angle of the central axis 134*i*, 134*ii* can be measured relative to a plane 136 defined by the seating surface 104 of the seat 102.

Specifically, in a first example shown in FIG. 4, the central axis 134*i* of the receptacle 122*i* and the plane defined by the seating surface 104 of the seat 102 enclose an angle of approximately 3°. In the second illustrated example, the central axis 134*ii* of the receptacle 122*ii* and the plane defined by the seating surface 104 of the seat 102 enclose an angle of approximately 87°. In other examples (not shown), the angle may range from approximately 5° to approximately 85°, or from 5° to 45°, or from 5° to 30°, or from approximately 30° to approximately 60°. In some examples (not shown), the angle may be approximately 4°, 5°, 10°, 15°, 20°, 25° or 30°. A person skilled in the art will appreciate that the defined force component of a user applying at least a portion of weight on the handles 112, 114 may depend on at least the angle and a shape and configuration of the handles 112, 114.

Referring back to the overall configuration of the shower chair 100 as shown in particular in FIGS. 1 and 2, the shower chair 100 is made relatively light weight compared to conventional shower chairs. In this regard, the seat 102, the back rest 108 and the handles 112, 114 are all made of a plastics material, in this particular example of polypropylene. However, a person skilled in the art will appreciate that other materials are envisaged, including but not limited to polyethylene (PE), polystyrene (PS), polyvinyl chloride (PVC) and nylon.

The seat 102, the back rest 108 and the pair of handles 112, 114 are manufactured using an injection moulding process. In this way, a majority of surface areas of these components can be provided with substantially smooth surfaces. This has the particular advantage that cleaning of the shower chair 100 can be simplified and a potential build-up of mould may be reduced.

Figure 5A:
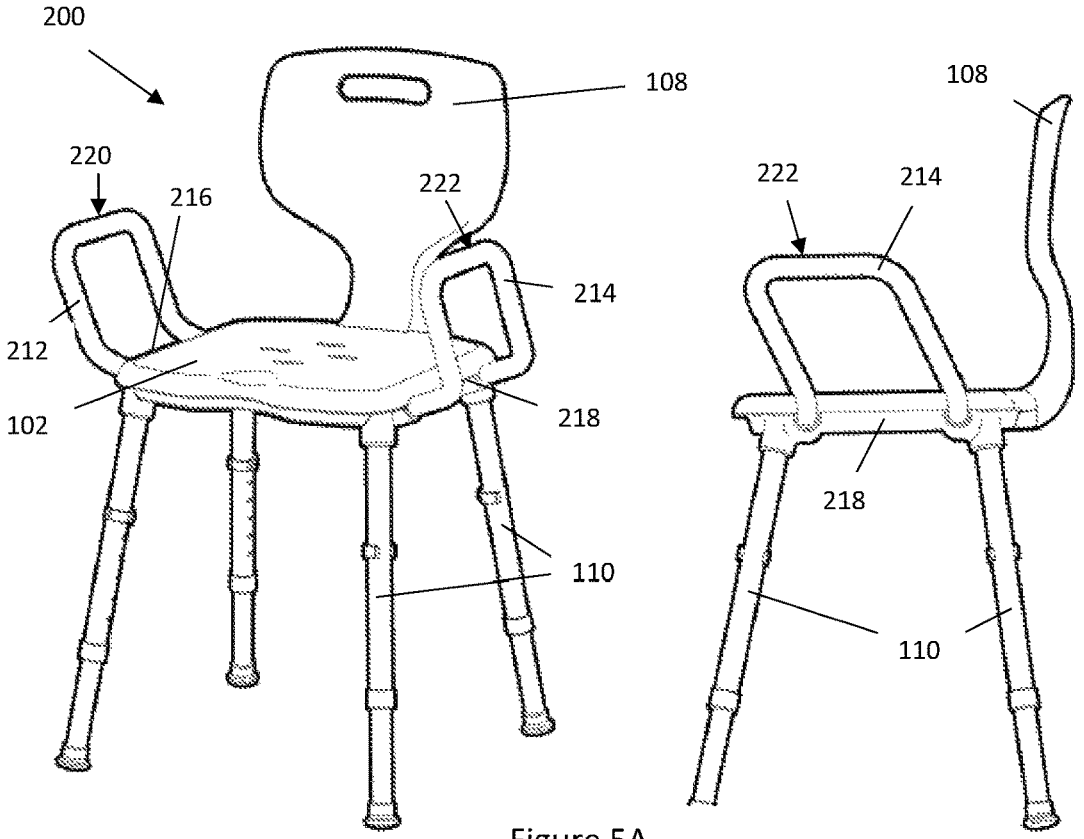
FIGS. 5A and 5B are schematic illustrations of a support device for assisting a user with showering in accordance with a further embodiment of the present invention.
Figure 5B:
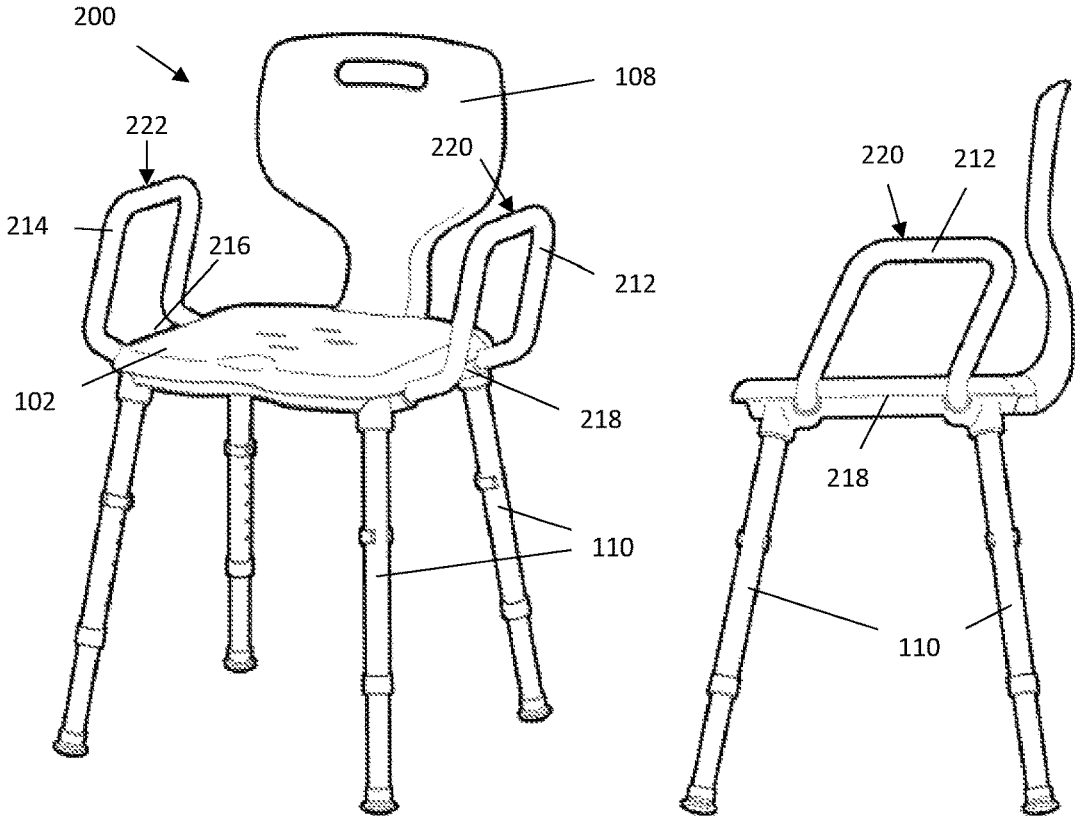

Referring now to FIGS. 5A and 5B, there is shown a shower chair 200 in accordance with a further embodiment of the present invention. It should be noted that like numerals refer to like components. Similar to the shower chair 100, the shower chair 200 comprises a seat 102 defining a seat surface 104, and back rest 108 and a plurality of legs 110 attached to the seat 102.

The shower chair 200 further comprises a first handle 212 which has a shape that is different to the shape of a second handle 214 as described in more detail below. Specifically, the first handle 212 is a mirror image of the second handle 214. The shower chair 200 is configured such that each handle 212, 214 is attachable to either side portion of the seat 102, i.e. a left or right side of the seat 102.

Referring initially to FIG. 5A, the first handle 212 is attached to a first side portion 216 of the seat 102, and the second handle 214 is attached to a second side portion 218 of the seat 102. In this particular configuration, armrest surfaces 220, 222 of the respective handles 212, 214 are positioned at a front portion of the seat 102. In this particular configuration, the shower chair 200 is configured to provide an increased space between the handles 212, 214 and the backrest 108 to allow for the user to reach the user's back for cleaning while being seated. This space may further be increased due to the shape of the backrest 108 as illustrated in the Figures. This is a significant improvement in functionality of the shower chair 200 as with conventional shower chairs the handles would typically obstruct the user's ability to reach the back. Furthermore, by positioning the arm rests at a front portion relative to the seat 102, the ability of standing up from the shower chair 200 may be improved due to the relative position of the arm rests.

In the second configuration shown in FIG. 5B, the first handle 212 is attached to the second side portion 218 of the seat 102, and the second handle 214 is attached to the first side portion 216 of the seat 102. In this configuration, the armrest surfaces 220, 222 of the respective handles 212, 214 are positioned at a rear portion of the seat 102 where the back rest 108 attaches to the seat 102. This configuration may be preferable to some users as it provides an increased leg gating in that the user can move the legs further apart. In this way, the ability of the user to reach and wash body parts that may otherwise be difficult to reach can be improved. Conventional shower chairs do not allow for such improved leg gating and the user would typically lift the weight from the seating surface to reach and wash between the legs. This is difficult in particular for elderly persons and persons with partial disabilities.

The improved leg gating is due to the specific shape of each handle 212, 214 and the selective positioning of the arm rests relative to the seat 102. In particular, each handle 212, 214 comprises an armrest section defining the armrest surfaces 220, 222 and first and second arms extending from the armrest section. In this regard, an angle between the first arm and the armrest section and an angle between the second arm and the armrest section are different so that each handle 212, 214 has a pre-defined direction. Thus, by selecting which handle 212, 214 is attached to which side portion 216, 218 of the seat 102, a relative position of the armrest surfaces 220, 222 can be changed. In this way, the shower chair 200 provides a greater flexibility for use compared with conventional shower chairs.

Figure 6A:
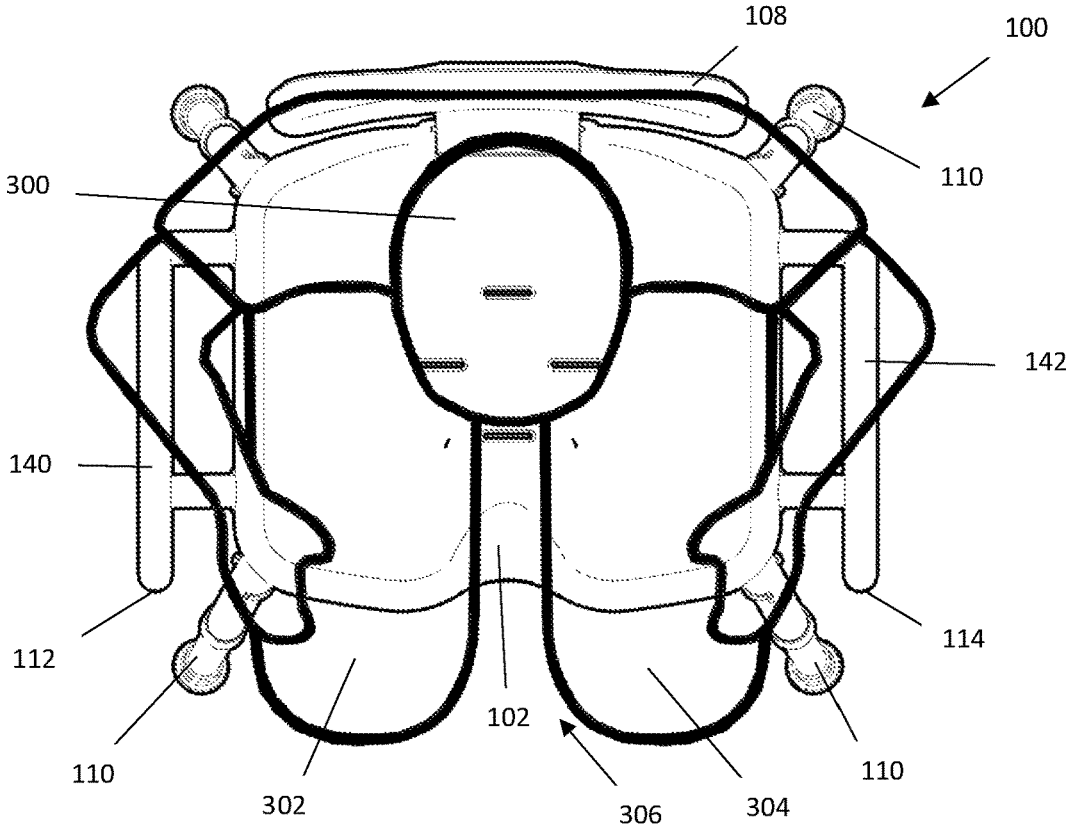
FIGS. 6A, 6B and 6C are top views of the support device of FIGS. 1 and 2, illustrating the possible movement of legs of a user (leg gating) while being seated.
Figure 6B:
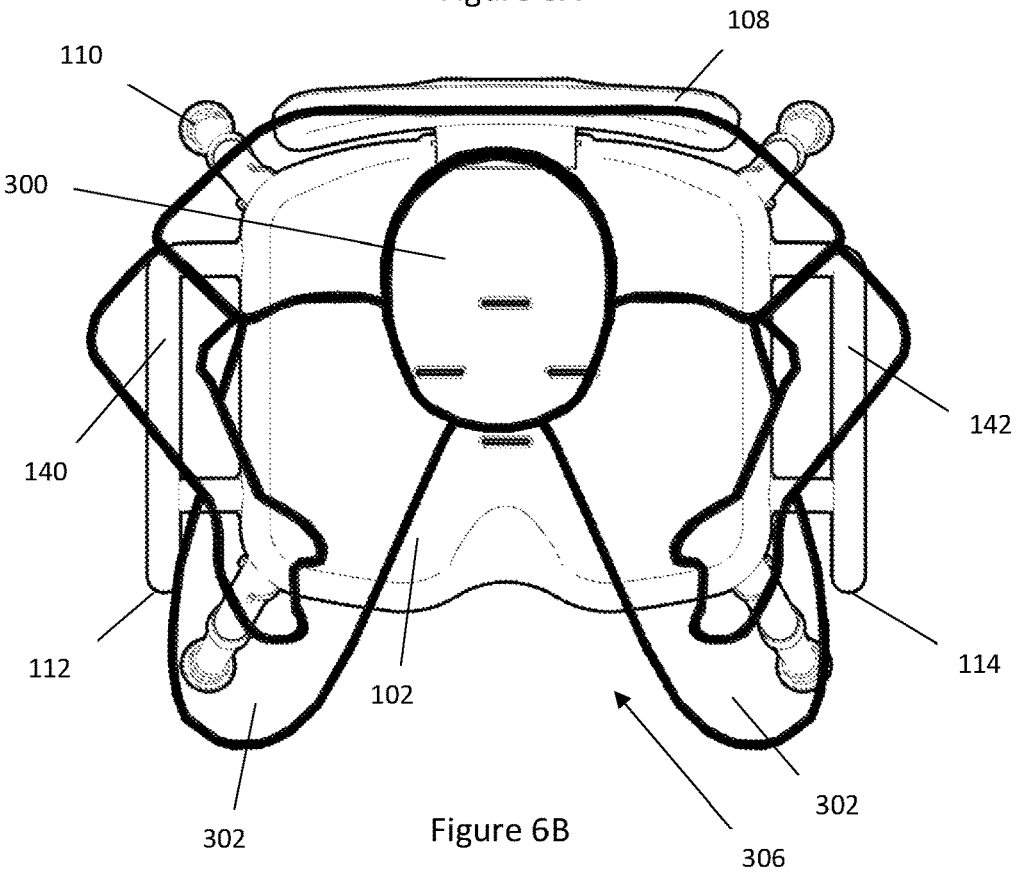
Figure 6C:
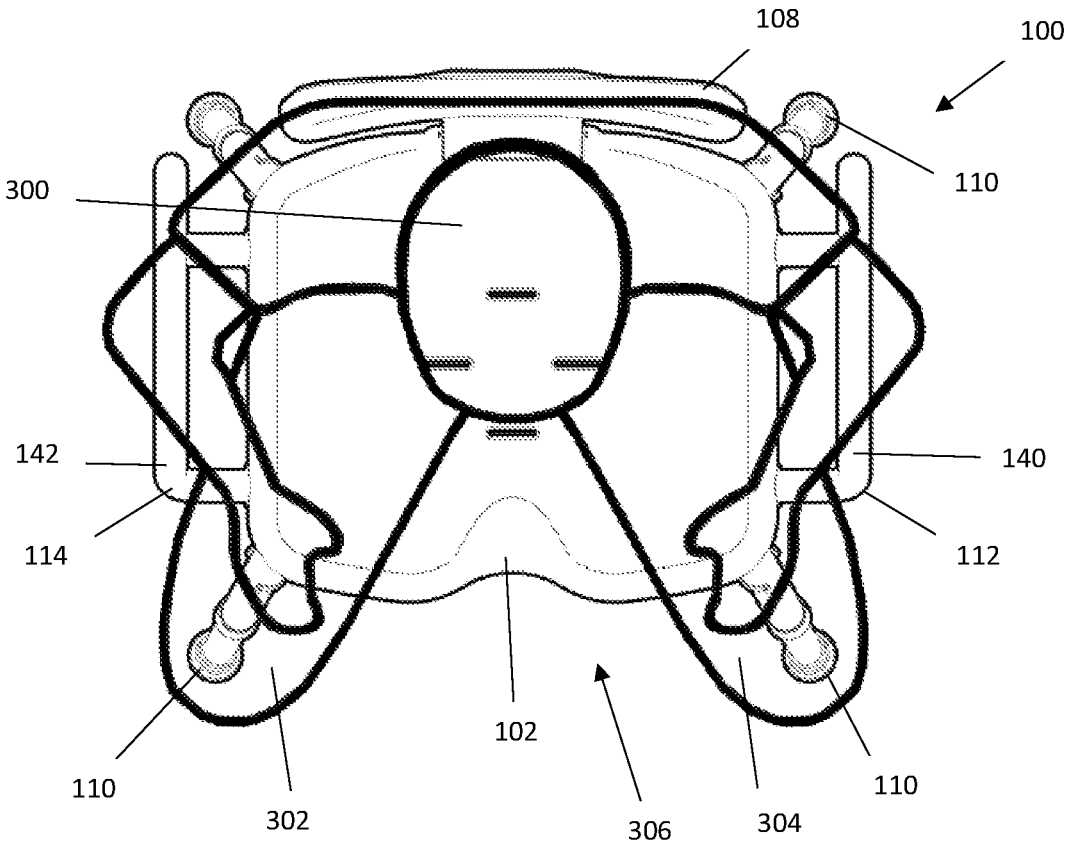

Referring now to FIGS. 6A, 6B and 6C, there is shown top views of the shower chair 100 of FIG. 1. These Figures illustrate the improved leg gating provided by the shower chair 100 in that a user can move the legs apart while the user is seated on the seat surface 104. Specifically, FIG. 6A illustrates the shower chair 100 with a user 300 being seated on the seating surface 104 defined by the seat 102 with both legs 302, 304 extending substantially parallel to each other. A relatively small gap 306 is defined between the two legs 302, 304. Each handle 112, 114 of the shower chair 100 is attached to the seat 102 so that the arm rests 140, 142 are provided at a front portion relative to the shower chair seat 102. The handles 112, 114 are further configured to provide a relatively large gap between the arm rests 140, 142 on which the user's arms may lean and the seat 102. As described above, the gap between the arm rests 140, 142 and the seat 102 is formed by virtue of the shape and size of the handles 112, 114. In particular, each handle 112, 114 comprises a C-shaped body that includes the arm rest 140, 142, and a pair of arms extending from the C-shaped body and configured to attach to the sides of the seat 102. This gap between the arm rests 140, 142 and the seat 102 provides the significant advantage that the user 300 may move one or both legs 302, 304 apart from each other to increase the gap or leg gating 306 between the legs 302, 304 as illustrated in FIG. 6B. The inventors of the present invention have found that this significantly improves the functionality and usability of the shower chair 100 in that a user can reach body parts that may otherwise be difficult to reach, without having to lift the user's weight from the seating surface 104.

Even more so, the leg gating 306 can be improved further by moving the handles 112, 114 in a position so that the arms rests 140, 142 are located at a rear portion of the seat. This configuration is illustrated in FIG. 6C.

The above embodiments shown in the accompanying drawings relate to a shower chair 100 and a shower chair 200. As mentioned above, a further embodiment of the present invention relates to a toilet seat riser. Toilet seat risers are typically positioned above a toilet bowl to raise a height of the seat to improve standing up from and siting down on the toilet. This is particularly important for elderly persons and persons with partial disabilities who may have difficulties in lifting their own weight.

The toilet seat riser in accordance with embodiments of the present invention has similar features as the above described shower chair 100. Specifically, the toilet seat riser may comprise a seat having a seating surface for supporting a weight of the user. Instead of apertures for drainage of water, the seat comprises a central aperture for waste disposal. The toilet seat riser further comprises a plurality of legs attached to the seat and a pair of handles configured to attach to substantially opposite side portions of the seat. Providing a pair of handles may assist the user in standing up from and lowering down on to the toilet. Each handle comprises a pair of end portions for attaching to the seat and each side portion of the seat comprises a pair of receptacles for snugly fitting the respective end portions of the handle. The toilet seat riser is configured such that a portion of the user's weight on the handles of the toilet seat riser applies a force that has a force component directed into each receptacle and parallel to a central axis of each receptacle.

The toilet seat riser may further comprise a securing element for securing each handle to the seat, for example, in the form of a hand-tighten fastener such as a thumb screw. In an embodiment, the toilet seat riser may be configured to be height adjustable. Additionally or alternatively, the toilet seat riser may be configured such that an angle of the seating surface is adjustable.

It will be appreciated by persons skilled in the art that numerous variations and/or modifications may be made to the invention as shown in the specific embodiments and/or aspects without departing from the spirit or scope of the invention as broadly described. For example, it will be apparent that certain features of the invention can be combined to form further embodiments. The present embodiments and aspects are, therefore, to be considered in all respects as illustrative and not restrictive. Several embodiments are described above with reference to the drawings. These drawings illustrate certain details of specific embodiments that implement the systems and methods and programs of the present invention. However, describing the invention with drawings should not be construed as imposing on the invention any limitations associated with features shown in the drawings.

The invention claimed is:

1. A support device for assisting a user in showering or toileting, the support device comprising:

a seat comprising a seating surface for supporting a weight of the user, and comprising side portions defining substantially opposite side faces;

a plurality of legs configured to attach to the seat;

a pair of handles configured to attach to the substantially opposite side faces of the seat, each handle comprising a pair of end portions for attaching to the seat; and a securing element for securing each handle to the seat;

wherein each side portion of the seat comprises a plurality of receptacles for snugly fitting the end portions of a respective handle, each receptacle extending into the seat so that respective end portions of the receptacles are flush with the substantially opposite side faces of the side portions of the seat, wherein each receptacle defines a central axis, the central axis and a plane defined by the seating surface of the seat enclosing an angle ranging from approximately 3° to approximately 87°, and wherein the support device is configured such that a portion of the user's weight on the handles of the support device applies a force that has a force component directed into each receptacle parallel to a central axis of each receptacle, and into the seat.

2. The support device of claim 1, being configured such that a majority force component of the force applied by the portion of the user's weight has a direction into each of the receptacles and parallel to the central axis of each of the receptacles.

3. The support device of claim 1, wherein each handle comprises a pair of tapering end portions for attaching to the seat.

4. The support device of claim 1, wherein the seat, the plurality of legs, the handles and the securing element are configured such that a volume of the support device can be minimised for transporting the support device, and wherein a transport volume of the support device is determined by a size of the seat.

5. The support device of claim 1, wherein the angle between the central axis of each receptacle and the plane defined by the seating surface ranges from approximately 5° to approximately 30°.

6. The support device of claim 1, wherein the angle between the central axis of each receptacle and the plane defined by the seating surface ranges from approximately 30° to approximately 60°.

7. The support device of claim 1, wherein the securing element is configured to restrain movement of each end portion of each handle away from the respective receptacle.

8. The support device of claim 1, wherein the securing element comprises a fastener configured to fasten each end portion of each handle to the seat.

9. The support device of claim 8, wherein the fastener is a hand-tighten fastener.

10. The support device of claim 9, wherein the hand-tighten fastener is a thumb screw.

11. The support device of claim 1, wherein each handle has an overall shape that is substantially C-shaped.

12. The support device of claim 1, wherein each handle comprises a body portion that is substantially C-shaped and a pair of arms extending from the C-shaped body portion.

13. The support device of claim 1, wherein the seat and/or the handles are made from a plastics material.

14. The support device of claim 1, being a shower chair or stool, or a toilet seat riser.

15. A shower chair or stool comprising:

a seat comprising a seating surface for supporting a weight of the user, and comprising side portions defining substantially opposite side faces;

a plurality of legs removably attached to the seat;

a pair of handles configured to attach to the substantially opposite side faces of the seat, each handle comprising a pair of tapering end portions for attaching to the seat; and a securing element for securing each handle to the seat;

wherein each side portion of the seat comprises a pair of receptacles for snugly fitting the respective tapering end portion of a respective handle, each receptacle extending into the seat so that respective end portions of the receptacles are flush with the substantially opposite side faces of the side portions of the seat, wherein each receptacle comprises a central axis, the central axis and a plane defined by the seating surface of the seat enclosing an angle ranging from approximately 3° to approximately 87°, and wherein the shower chair or stool is configured such that a portion of the user's weight on the handles of the support device applies a force that has a force component directed into each receptacle parallel to a central axis of each receptacle, and into the seat.

16. A toilet seat riser comprising:

a seat comprising a seating surface for supporting a weight of the user, and comprising side portions defining substantially opposite side faces, the seat comprising a central aperture for waste disposal;

a plurality of legs removably attached to the seat;

a pair of handles configured to attach to the substantially opposite side faces of the seat, each handle comprising a pair of end portions for attaching to the seat; and a securing element for securing each handle to the seat;

wherein each of the substantially opposite side faces of the side portions of the seat comprises a pair of receptacles for snugly fitting the respective end portions of a respective handle, each receptacle extending into the seat so that respective end portions of the receptacles are flush with the substantially opposite side faces of the side portions of the seat, wherein each receptacles comprises a central axis, the central axis and a plane defined by the seating surface of the seat enclosing an angle ranging from approximately 3° to approximately 87°, and wherein the toilet seat riser is configured such that a portion of the user's weight on the handles of the support device applies a force that has a force component directed into each receptacle parallel to a central axis of each receptacle, and into the seat.

17. A support device for assisting a user in showering or toileting, the support device comprising:

a seat comprising a seating surface for supporting a weight of the user, and comprising side portions defining substantially opposite side faces;

a plurality of legs attached to the seat; and a pair of handles configured to attach to the substantially opposite side faces of the seat, each handle comprising a pair of tapering end portion for attaching to the seat;

wherein each side portions of the seat comprises a plurality of receptacles for snugly fitting the tapering end portions of a respective handle, each receptacle extending into the seat so that respective end portions of the receptacles are flush with the substantially opposite side faces of the side portions of the seat, wherein each receptacles defines a central axis, the central axis and a plane defined by the seating surface of the seat enclosing an angle ranging from approximately 3° to approximately 87°, and wherein the support device is configured such that a portion of the user's weight on the handles of the support device applies a force that has a force component directed into each receptacle parallel to a central axis of each receptacle, and into the seat.

* * * * *